US006186436B1

(12) United States Patent
Selle et al.

(10) Patent No.: US 6,186,436 B1
(45) Date of Patent: Feb. 13, 2001

(54) BAG WINDER AND METHOD THEREOF

(75) Inventors: Paul Selle; Kenneth Radtke; Francis Binder, all of Appleton, WI (US)

(73) Assignee: CMD Corporation, Appleton, WI (US)

( * ) Notice: Under 35 U.S.C. 154(b), the term of this patent shall be extended for 0 days.

(21) Appl. No.: 09/176,364

(22) Filed: Oct. 21, 1998

(51) Int. Cl.[7] ..... B65H 19/28
(52) U.S. Cl. ..... 242/532.2; 242/533.6
(58) Field of Search ..... 242/532.2, 532.7, 242/533.4, 533.5, 533, 533.6, 533.7

(56) References Cited

U.S. PATENT DOCUMENTS

| | | | | |
|---|---|---|---|---|
| 3,527,424 | * | 9/1970 | Goldman | 242/532.2 |
| 3,908,924 | * | 9/1975 | Schulze | 242/532.2 X |
| 4,030,674 | * | 6/1977 | Vedani | 242/532.2 X |
| 4,667,890 | | 5/1987 | Gietman, Jr. . | |
| 5,016,833 | * | 5/1991 | Hamlin | 242/533 |
| 5,131,592 | * | 7/1992 | Shibata et al. | 242/532.7 |
| 5,318,237 | | 6/1994 | Lotto et al. . | |
| 5,337,968 | * | 8/1994 | De Bin et al. . | |
| 5,897,070 | * | 4/1999 | Kojima | 242/532.7 X |
| 5,899,403 | * | 5/1999 | Gietman, Jr. et al. | 242/532.2 X |

* cited by examiner

*Primary Examiner*—Donald P. Walsh
*Assistant Examiner*—William A. Rivera
(74) *Attorney, Agent, or Firm*—George R. Corrigan

(57) ABSTRACT

A method and apparatus for winding film includes haul-in rolls, a spindle, an airhorn, a kick-roll, and a belt or ropes to convey the film. A source of air creates an air curtain downstream of the spindle. The air curtain directs the leading edge of the film into the airhorn and over the spindle. A film guide located upstream of the airhorn guides a leading edge of the film back into its own nip. An air guide located between the film guide and the conveyor leading to the spindle prevents air from going back upstream of the airhorn. The guides are comprised of a non-stick material. Holes near the edge of guide allow air to exit the air horn, without perturbing the film where it tucks into its own nip. A static pinner may pin the leading edge of the film to the spindle. The spindle may have a winding surface tapered by less 0.03 inches per foot. The spindle has an air inlet, and outlet holes. The inlet area is greater than the hole area, by up to a 7:1 ratio. The spindle surface may have a non-stick surface, or have a liquid lubricant applied thereto. A yoke may be used to remove rolls, and the yoke contacts the spindle in substantially 360 degrees, or a push-off palm may be used to remove the roll and contacts the spindle in two places.

40 Claims, 3 Drawing Sheets

BAG WINDER AND METHOD THEREOF

FIELD OF THE INVENTION

The present invention relates generally to the art of winding equipment. More specifically, it relates to equipment for winding strips of elongate, pliable material, such as paper or plastic, into core or coreless rolls.

BACKGROUND OF THE INVENTION

Equipment for winding material into core and coreless rolls is known in the art. For purposes of illustrating such prior art, one particular type of coreless plastic bag winder will be described, i.e., a winder for plastic garbage or trash bags, kitchen bags, wastebasket liners, food storage bags, etc. Further background regarding bag winders may be found in U.S. patent application Ser. No. 08/662,311, entitled Method And Apparatus For Winding Bags Onto A Spindle, Gietman et al., filed Jun. 11, 1996, which is hereby incorporated by reference.

Generally, a continuous strip of bags is fed to the winder, and the winder prepares coreless rolls therefrom. The bags themselves are produced in upstream bag making equipment or on a separate piece of equipment, from which a continuous strip of bags is produced.

In most conventional bag making equipment a tube of plastic film is extruded through an extruding die, and the tube is then flattened before it enters the bag machine. In the bag machine the film is sealed across its width to form the bottom of the finished product. The open top of the bag can be formed in different ways. For example, the bag can simply be cut. In this type of bag machine, individual bags are formed which are typically folded and placed into suitable packaging for the individual or institutional consumer. In the other type of bag machine, the top is formed by perforating the bag across its width. The bag may then be folded longitudinally, either before or after the perforation step, to provide a continuous strip of connected and folded bags. Such bags are then wound into a core or coreless roll.

One prior art winder has been sold by CMD Corporation Appleton, Wis., the assignee of the present invention. Such winder includes a dancer mechanism to sense the tension of the strip of bags being fed to the winder. The dancer mechanism includes a connection to the winder drive motor, wherein the speed of the winder can be "slaved" to the output speed of an upstream bag making equipment.

The prior art winder also includes haul-off nip rollers, to feed the strip into the winder, and an interrupt section to periodically break the perforations between certain bags in the strip. The frequency of the interruption is determined by the number of bags to be included in each roll. For example, if the roll is to contain twenty bags, the interrupt section will break every twentieth perforation.

Downstream of these sections, the prior art winder includes a turret assembly with three spindles mounted 120° apart. To begin winding a roll of bags the leading end of one strip of bags is directed to a first spindle when the turret is in a transfer position. After the bag is secured to the spindle by a transfer mechanism such as that described in U.S. Pat. No. 4,667,890, incorporated herein by reference, the turret is rotated 120° so that the first spindle is in a winding position and the strip is wound into a coreless roll. Following completion of the roll winding, the turret rotates again to a removal station where the roll is pushed off the first spindle by a push-off palm for subsequent packaging. When the winding of the one roll is completed the leading end of the film is directed to a second spindle in the transfer position.

A variety of prior art mechanisms are used to direct the leading end of a strip to the spindle. Generally, an airhorn and kick-roll mechanism were used to effect the transfer. The kick-roll is a pneumatic activated roller located beneath a traveling belt at the area near the transfer location. At the time of transfer, the roller would be extended by a piston rod to quickly push against the belt to "flip" the leading edge of the strip of bags up into the air above the lower belt. At the same time, an airhorn would descend around the spindle, the airhorn being a half-cylinder containing air ports on one edge. The combination was intended to direct the leading edge of the bag strip around the spindle and tuck it into its own nip to create the attachment. Another system used "fingers" that passed between the ropes and/or an air blast between the ropes carrying the film and to deflect the leading edge of the film into the airhorn (alone or in combination with the other mechanisms). Prior art air horns are shown in U.S. Pat. Nos. 5,318,237 and 5,337,698.

These systems, while being better than earlier systems, suffers from drawbacks including ineffective transfers, such as a failure of the leading edge to tuck into its own nip. This failure is caused in part by air currents in and near the air-horn, and in part by the structure used to direct the leading edge. Because of the high speeds utilized in winders if the airhorn and kick-roll system failed to properly attach the moving plastic web to the spindle, a great deal of waste would occur before the next strip would arrive at the transfer position.

One prior art design blows air directly at the film as it crests over the kick roll in an effort to direct the film into the airhorn. However if the air hits the film improperly it will blow the film back down so that it continues on away from the air horn instead of blowing it back up into the airhorn.

Another problem with the prior art is that a second row of air holes blowing air up into the air horn can cause the film to stick to the horn instead of the spindle. Yet another problem is that as the film travels around the air horn its shape did a poor job of tucking the film back in at the bottom of the spindle to cause the film to nip within itself. Other problems with prior art designs is that there were numerous critical physical orientations and distances, such as the distance from the kick roll to the spindle and/or air horn, and the angle of air to the leading edge of the film. If any of the critical parameters weren't met the winder would likely not wind properly. Thus, when servicing a winder it was often difficult to put the winder back into use (i.e. set up).

Accordingly, a winder which economically and effectively transferred a leading edge of a strip of plastic to a spindle would represent a significant advance in the art. Such a winder will preferably be easy to set up.

Prior art designs often used compressed air injected into a spindle at the unloading position to lubricate the spindle surface to make roll removal easier. (See, for example, U.S. Pat. No. 5,337,968). Another prior art feature intended to make roll removal easier is a tapered spindle. Prior art spindles often provided a large taper, such as about 0.06 in. diameter reduction per foot, in the belief that it would make removal of roll 302 easier.

Prior art spindles failed to properly account for the proper ratio of air inlet area to air outlet area of the spindle when designing the air lubricant system. For example, some prior art designs were unable to build up a sufficiently large back pressure at the face of the spindle, thus they were unable to force the roll to expand enough to float on a cushion of air. The air lubricant system typically included a plurality of air holes through which air can be selectively injected.

Accordingly, a spindle design that provides for an effective and easy removal is desirable. Such a system should have a suitable back pressure.

Roll removal is typically performed by a push-off palm (after the air lubrication is provided). A prior art push palm plate used by the assignee of this invention included a slot without contact with the spindle. The spindle can be surrounded by the palm in one quadrant, or all four quadrants. However, four quadrant palms have excessive moving parts to move into position, and are thus prone to failure. Accordingly, a push-off palm that properly pushes a roll off, without being prone to failure, is desired.

SUMMARY OF THE PRESENT INVENTION

According to a first aspect of the invention an apparatus for winding film includes a pair of haul-in rolls, a rotatable spindle, and an airhorn. The airhorn is movable to be disposed over the spindle. A film guide is located on the upstream side of the airhorn (i.e. the upstream film path before the film enters the airhorn), and guides a leading edge of the film back into its own nip.

According to a second aspect of the invention an apparatus for winding film includes a pair of haul-in rolls, a rotatable spindle, and an airhorn. The airhorn is movable to be disposed over the spindle. An air guide is located between the air horn and the film path leading to the spindle, and keeps air from moving out of the airhorn and upstream.

According to a third aspect of the invention a winder for film includes a pair of haul-in rolls and a conveyor to transport the film from the haul-in rolls to the airhorn. A rotatable spindle, and an airhorn that moves to the spindle are also included. A mounting block is attached to the downstream side of the airhorn, and above the conveyor. Compressed air is injected into the mounting block, and it causes air flow between the conveyor and the block, and from the source of air to the air horn, thus creating a curtain of air downstream of the spindle, such that air directs the leading edge of the film into the airhorn and towards the spindle. Injection of compressed air may be accomplished by a source of air mounted on the mounting block, disposed to create the air flow.

One embodiment provides a kick-roll downstream of the spindle. Another embodiment provides holes in the film guide so that air may exit the air horn through the holes or so that deflectors may be inserted through the holes to further direct the leading edge of the film into its own nip.

One alternative embodiment has the air and film guides being made of non-stick materials. Another embodiment provides for a static pinner to pin or cling the leading edge of the film to the spindle.

In various embodiments the spindle has a winding surface, and the winding surface diameter is tapered by about 0.014 inches per foot or less.

The spindle has an air inlet, and a plurality of holes in other embodiments. The inlet area is greater than the hole area, at least about four times greater than the hole area, or at least about seven times greater than the hole area in various alternatives.

The spindle may be coated with a non-stick surface or have a liquid lubricant applied thereto.

In yet another alternative a roll remover is disposed at a roll removal position, and the roll remover contacts the spindle and pushes off the wound roll. The roll remover may be a yoke or a palm, and may contact the spindle at one or more points, over a portion of the spindle, or over substantially 360 degrees.

Other principal features and advantages of the invention will become apparent to those skilled in the art upon review of the following drawings, the detailed description and the appended claims.

Figure 1:
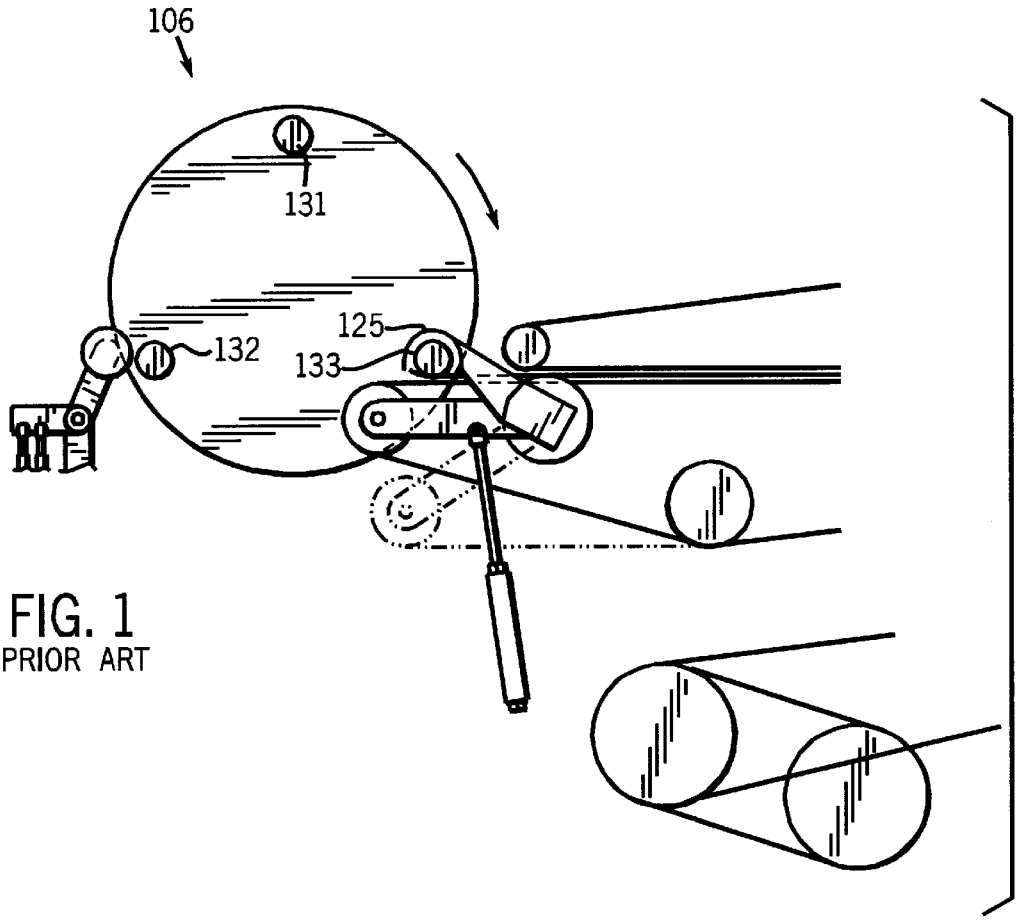
FIG. 1 PRIOR ART
FIG. 1 is a prior art winder.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to its use as a winder for strips of plastic bags, it should be understood at the outset that the winder can also be employed for winding other pliable materials, such as paper or plastic sheets. The material being wound should have sufficient tear strength to be able to withstand the winding forces imposed at the transfer and surface-wind stations. For example, plastic sheeting, paper and tissue products and the like could be wound using the winder of the present invention after appropriate modification, which would be readily apparent to one skilled in the art after reading the present disclosure.

The winder of the present invention is designed to be used with a rotary bag making machine, although it could be used with other types of machines. The winder includes a turret with a plurality of spindles mounted thereon, such as that used in the prior art. FIG. 1 is a prior art winder and includes a turret assembly 106, where the film travels from right to left. The details of the prior art design are described in application Ser. No. 08/662,311. In the preferred embodiment turret assembly 106 includes 4 (rather than 3) spindles 131–133.

One aspect of the present invention is an airhorn and surrounding components that replace airhorn 125 of the prior art. This aspect of the invention is best seen with respect to FIG. 2, which shows an air horn assembly 200, including a horn 210 mounted on an arm 211, which pivots about a pivot point 212. Air horn assembly 200 also includes a pair of guides 202 and 204, and an air curtain 214 which is attached to air horn 210. Also shown are a spindle 206, which may be an inventive spindle as described below or a prior art spindle, and a kick roll 205 (such as in the prior art). A belt, ropes, or other film conveyor 208 are shown and are used to guide the film from right to left into the airhorn.

Guide 202 is a non-stick material, such as a teflon coated fabric, shaped in one part as a curve to help form the airhorn, and in another part generally straight. (As used herein a material is non-stick if the co-efficient of friction between the material and the film is less than the co-efficient of friction between the film and polished steel). It is bolted by a plurality of bolts 201 (that extend in the direction perpendicular to the paper) at the end of the curved portion and onto bracket 203 along the straight portion. Guide 204 is also a teflon coated fabric, and is bolted at one end to bracket 203, and at the other end terminates slightly beyond the inflection point of guide 202.

To start winding a roll, airhorn assembly 200 is pivoted downward to spindle 206. The film path is from right to left and as the film moves under air horn assembly 200 it approaches kick roll 205, which kicks the film up and, in cooperation with an air curtain in the preferred embodiment, directs the leading edge of the film into the air horn.

The preferred embodiment includes an air curtain 214. Air curtain 214 is created by a piece of aluminum 215 mounted to block 216 such that a gap of 0.002 in. gap 219 exists therebetween. Air is provided through block 216 such that it leaks out gap 219. The air follows the surface of block 216, and flows between the surface of block 216 and belt 208, as shown by arrow 217, and travels into the air horn, thus forming the air curtain. The air curtain directs and holds the film to the roll from about the 9:00 to 2:00 positions.

Thus, air movement around the airhorn is such that the leading edge of the film is pulled into the downstream side of the airhorn by air movement (which cooperates with the kick roll). The film typically contacts spindle 206 at about the nine-o-clock position. The film travels with the spindle, and is held to the spindle by air from the air curtain until about the two or three o'clock position, where it has a tendency to peel away from spindle 206. Guide or deflector 202 directs the film downward. Guides 202 and 204 are teflon in the preferred embodiment so that there is little friction between it and the film. One or both of guides 202 and 204 are made of other material, or omitted, in alternative embodiments.

The air moving around spindle 206 has the tendency to go in the upstream direction (upstream refers to the film path before the film reaches the airhorn) at about the 4:30 position. The air would travel along the surface of the incoming film, and can bring the leading edge with it. Of course, this would have an adverse impact on the starting of a roll to be wound. Accordingly, air guide or shield 204 seals the air away from the upstream direction and around the spindle, thus helping to direct the film around the spindle so that it forms a nip with itself and begins to wind. Guide 204 is comprised of a thicker, heavier material than a teflon fabric in one embodiment, and is omitted in another embodiment.

Figure 2:
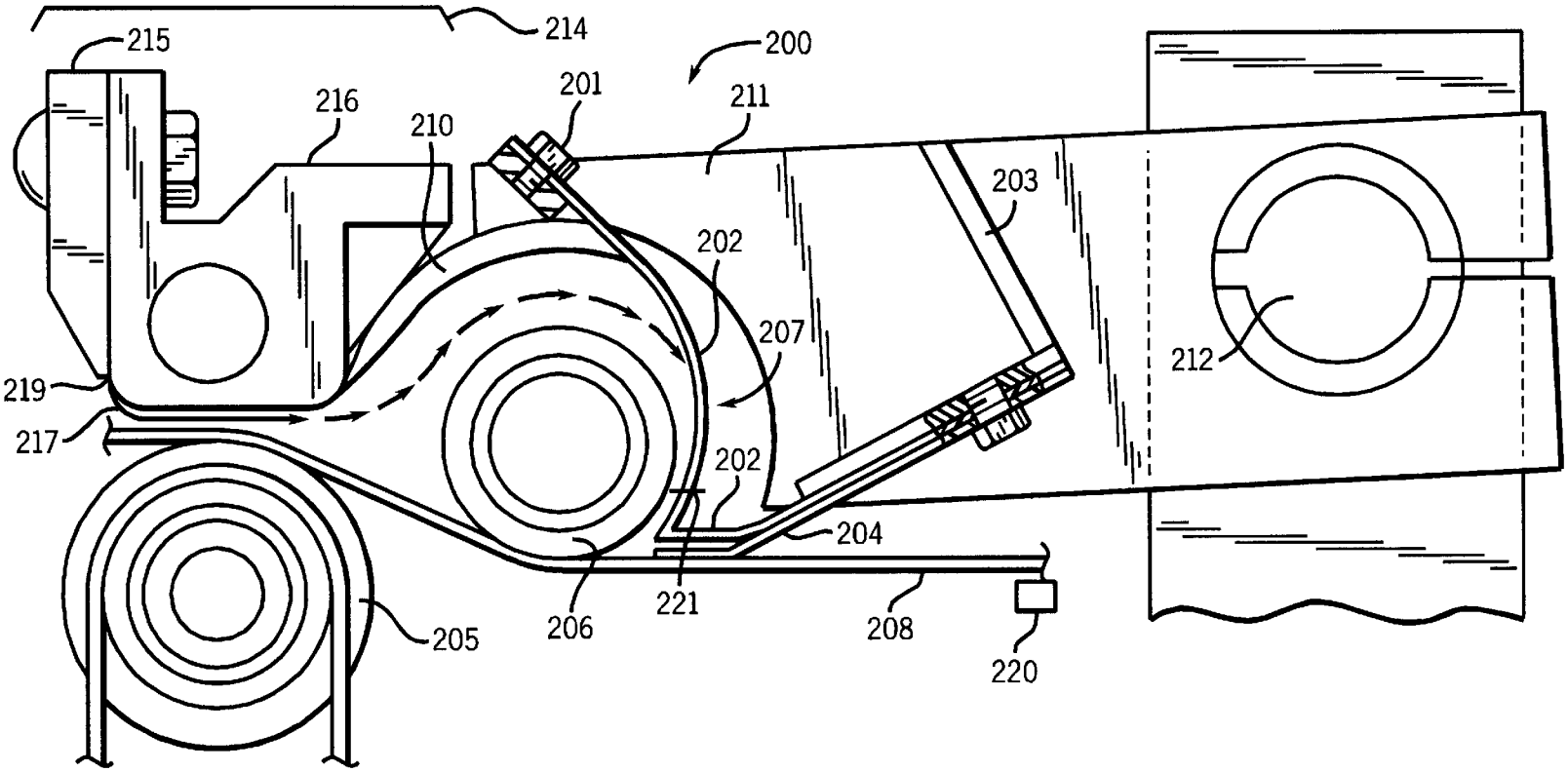
FIG. 2 is an air horn in accordance with the present invention.

Alternative designs include a series of holes through guide 202, for example at the location marked 207 on FIG. 2, where the holes extend in a plane perpendicular to the view shown. The holes provide an escape for air so that the film is disturbed less in the tucking area at the bottom of the spindle. The holes may be close (0.25–0.5 inches, e.g.) to the crease of guide 202. Absent this alternative, air will escape out the ends of airhorn 210 (in the planes parallel to the Figure). Another alternative is to have fingers 221 extending through holes to tuck the film into a nip. The holes with the fingers 221 therein could be located at 207 on FIG. 2. Yet another alternative is to use a static pinner 220 as part of the air horn to pin or cling the film to a grounded spindle.

The preferred embodiment provides that the distances between the various parts are preferably not critical, in that a range of distances and angles will suffice. Generally, the user should empirically determine the best distances and angles (or ranges thereof) for the particular equipment used to implement the invention. While distances appear to be less critical with this invention than with the prior art, the inventors have determined that a distance of about 0.25–0.31 inches from the airhorn to the spindle and about 0.19 inches from kick roll 205 to block 216 works well for equipment made by the assignee of this invention.

Figure 3:
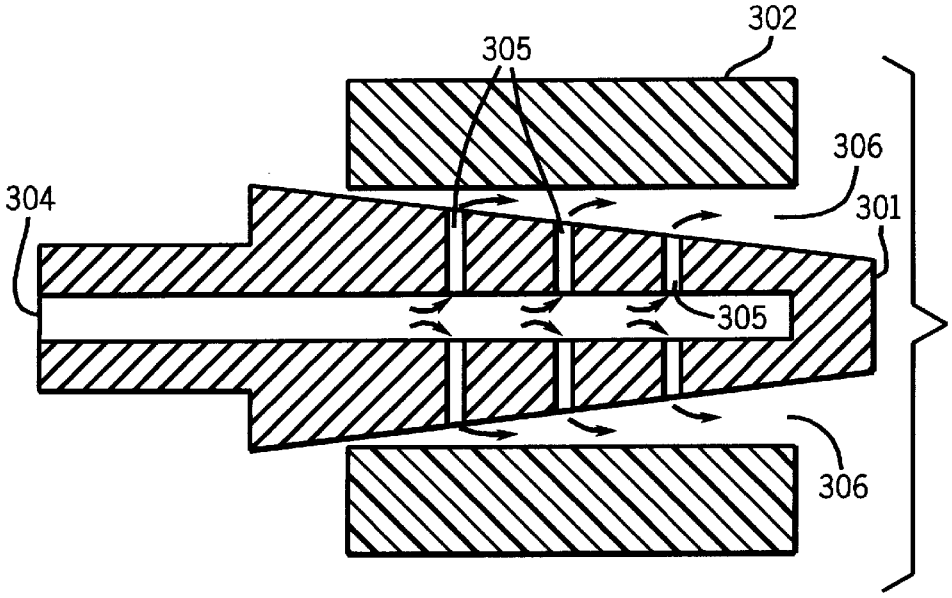
FIG. 3 is a representation of a spindle illustrating the present invention.
Figure 4:
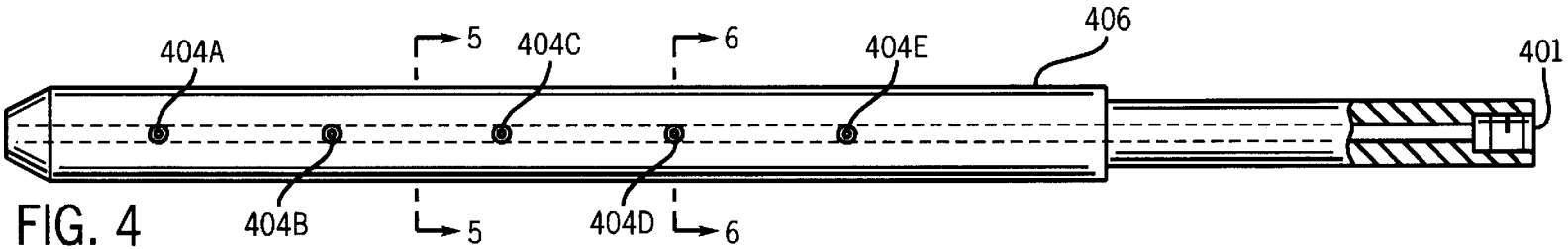
FIG. 4 is front view of a spindle in accordance with the present invention.
Figure 5:
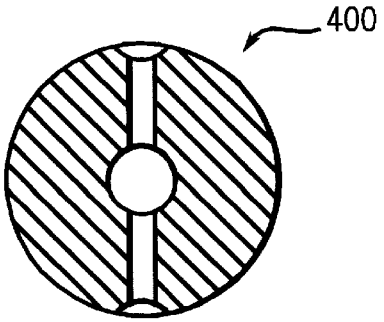
FIG. 5 is sectional view of a spindle taken along lines 5—5.
Figure 6:
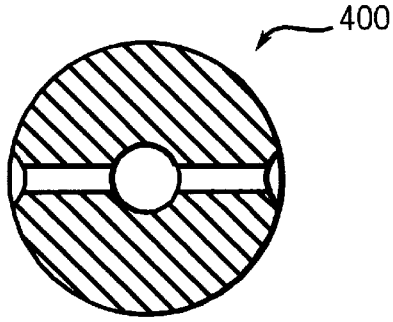
FIG. 6 is sectional view of a spindle taken along lines 6—6.

Another aspect of the present invention is a spindle with a taper and an air lubricant system that provides for more effective removal of wound rolls. This invention allows rolls to be pushed off easier than prior art designs (twice as easy, e.g.), which reduces telescoping of the roll, by a factor of twelve for some films, e.g. FIG. 3 is a schematic of a spindle and roll that illustrates the operating principles of this aspect of the invention. FIGS. 4–6 are drawings of a spindle constructed in accordance with this invention.

FIG. 3 includes a spindle 301 and a roll of wound film 302, after the film has been pushed away from spindle 301 by air pressure. The relative sizes, angles, dimensions, and positions of spindle 301 and roll 302 are exaggerated for purposes of illustration. Spindle 301 includes an air inlet 304, and a plurality of holes 305. Air is provided through air inlet 304, and exits spindle 301 through holes 305. The air creates a pressure against roll 302, that forces roll 302 outward and thus creating a cushion of lubricant so that roll 302 may be more easily removed. The air exhausts through an annulus 306, between roll 302 and the end of spindle 301.

The pressure that is exerted on roll 302 depends upon the pressure of the air supply, the cross-sectional area of air inlet 304 (inlet area), the combined cross-sectional areas of outlet holes 305 (hole area), and the area of annulus 306 (escape area). Thus, these areas (and the taper of spindle 301 which determines the area of annulus 306) should be chosen such that a desired pressure is exerted on roll 302.

If the area of inlet 304 is much greater than the combined area of holes 305 then the pressure inside spindle 301 (Pin) is close to the pressure of the air supply. A greater Pin provides a greater pressure exerted on roll 302 (for a given annulus area).

Most industrial plants have a 90 PSI air supply. The applicants have determined that a ratio of 7:1 for the inlet area to the combined hole area will provide for a Pin of about 80 PSI (given a 90 PSI supply). A ratio of 4:1 provides about 75 PSI, a ratio of 1:1 provides about 30 PSI, and a ratio of about 1:4 (a typical prior art ratio) provides only 15 PSI for Pin. Thus, it may be seen that a ratio of at least 1:1 for inlet area to hole area is desirable, and a ratio of 4:1 more desirable, and a ratio of 7:1 or more is also desirable.

The optimal ratio and Pin may depend on the equipment being used, the weight of the film being wound, and other parameters. The preferred embodiment provides that a Pin of 60 PSI is preferable for low density polyurethane and a Pin of 40 PSI is preferable for high density polyurethane. This is obtained by using a 90 PSI source, a 7:1 ratio of inlet area to hole area, and a regulator to regulate down the source pressure to obtain the desired Pin.

A spindle constructed in accordance with the preferred embodiment is shown in FIGS. 4–6. FIG. 4 is a front view of a spindle 400, and FIG. 5 and 6 are section taken along lines 5—5, and 6—6, respectively. Spindle 400 is mounted to the turret at an end 401, through which air is provided into spindle 400. When spindle 400 rotates into the push-off position, an air source located at that position seals against a rubber grommet at end 401 of the spindle.

A plurality of holes 404 are shown, and the film is wound about the portion on which the holes are mounted. The preferred embodiment provides a taper of about 0.06 inches change in diameter per foot. In various alternatives a lesser taper of about 0.03 inches, or about 0.015 inches or less, is provided. Thus, the left end of spindle 400 of FIG. 4 is narrower than the right end.

Holes 404 are disposed over the entire area about which the film roll is wrapped (i.e., the winding surface) in the preferred embodiment (although other arrangements may be used). The film is wrapped generally from the change in diameter near 406 to the far left end of spindle 400 in the preferred embodiment (12 inches e.g.). Spindle 406 is mounted in bearings just to the right of 406, in the preferred embodiment. A push off palm (such as the inventive push off palm described below, or a push off palm of the type known in the prior art) is disposed on the shaft to the left of 406.

Holes 404 are preferably counter-sunk, which increases the surface area which has the Pin pressure applied thereto. There are 22 holes in the preferred embodiment, each about 0.02 inch diameter. The air inlet at end 401 has a diameter of about ¼ inch. This yields an inlet area of about 0.049 $in^2$, and a hole area of about 0.007 $in^2$, for about a 7:1 ratio.

One alternative provides that the spindle surface finish is polished to remove machining lines and to smooth the edges of the counter-sink of holes 404 such that the wrapped film will not settle into a circular groove or stick to the counter-sinks. Another alternative provides that a permanent surface coating which is non-stick is applied to the spindle. This allows for a more easily removable roll. Another alternative provides a liquid lubricant, such as silicone, on the surface of the spindle each time the machine cycles.

Figure 7:
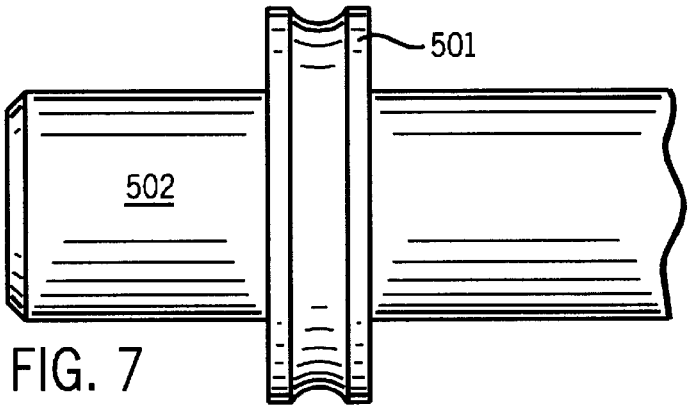
FIG. 7 is a yoke and spindle in accordance with the present invention.

Another aspect of this invention is a scraping push-off palm or other roll remover. The spindle is scraped to prevent the roll from telescoping wherein film along the spindle binds in the gap between the palm and the spindle. FIG. 7 shows one embodiment of a yoke 501 mounted about a spindle 502 that provides a full 360 degrees of contact to spindle 501. The yoke may be moved by a traditional push-off palm (which does not contact the spindle at all since the yoke contacts the spindle). Alternatively, yoke 501 may be moved by an activator at the unloading station. Yoke 501 primarily pushes the rolls inner layers from the spindle. Yoke 501 has a small outer diameter (relative to the roll diameter) to prevent pushing outer layers of the roll if the roll is telescoped. Yoke 501 is slightly undersized so that it stays tight to spindle 502, even if spindle 502 is tapered. Alternatives to a complete contact is having two or more segments in contact, with gaps therebetween.

One alternative embodiment is to use one or more points of contact between the palm and the spindle. However, if the palm touches at only one point or on only one side, then the roll can cock and lock onto the spindle. Thus, preferred embodiments use a multiple point contact. For example, a two contact palm should avoid cocking the roll if the two points are offset by 180 degrees. Other alternatives include three, four, or more, preferably equally spaced, contact points. However, a two point contact palm may be simpler, easier to make, and less prone to failure than a four point (or four quadrant) palm.

Figure 8:
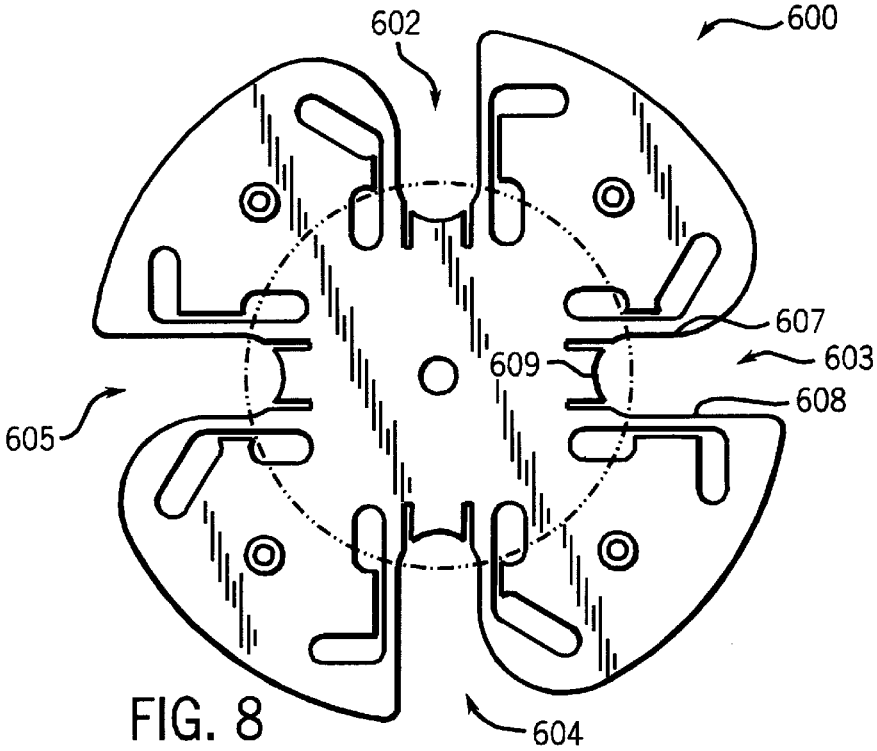
FIG. 8 is a push-off palm in accordance with the present invention.

FIG. 8 shows a two point contact palm 600, having four slots 602–605 thereon. Each slot is similarly designed, and functions similarly. Thus, only slot 603 will be described. Two contact points 607 and 608 are shown. Palm 600 includes steel behind the contact points, for added support. The contact points are made of ½ inch THK Nylatron GSM® in one embodiment. The spindle slips within each slot, contacting sides 607 and 608, but leaving a small (0.06 in., e.g.) between the spindle and the inside of the slot (609).

Numerous modifications may be made to the present invention which still fall within the intended scope hereof. Thus, it should be apparent that there has been provided in accordance with the present invention a method and apparatus for winding bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An apparatus for winding film from a pair of haul-in rolls comprising:

a rotatable spindle;

an airhorn, movable to be disposed over the spindle;

a film conveyer, to convey the film from the haul-in rolls to the spindle; and a film guide, located within the airhorn on the upstream side of the airhorn, to guide a leading edge of the film back into its own nip at about the two to three o'clock position in the airhorn.

2. The apparatus of claim 1 further including a kick-roll disposed downstream of the spindle.

3. The apparatus of claim 2 including an air guide located between the film guide and the conveyor leading to the spindle.

4. The apparatus of claim 3 wherein the film guide and the air guide are comprised of a material that is non-stick.

5. The apparatus of claim 2 wherein the airhorn includes a static pinner disposed to pin the leading edge of the film to the spindle.

6. The apparatus of claim 1 further including a plurality of holes in the film guide, and near a point of inflection of the guide, such that air may exit the airhorn through the holes.

7. The apparatus of claim 1 further including a plurality of holes in the film guide, and near a point of inflection of the guide, such that fingers may be inserted through the holes to further direct the leading edge of the film into its own nip.

8. The apparatus of claim 1 wherein the airhorn includes a static pinner disposed to pin the leading edge of the film to the spindle.

9. The apparatus of claim 1 wherein the spindle has a winding surface, and the winding surface diameter is tapered by no more 0.03 inches per foot.

10. The apparatus of claim 1 wherein the spindle has an air inlet, and a plurality of outlet holes, and the inlet area is greater than the hole area.

11. The apparatus of claim 10 wherein the inlet area is at least about four times greater than the hole area.

12. The apparatus of claim 10 wherein the inlet area is at least about seven times greater than the hole area.

13. The apparatus of claim 1 wherein the spindle surface is a non-stick surface.

14. The apparatus of claim 1 further including a source of a liquid lubricant disposed to apply the liquid lubricant to the spindle.

15. The apparatus of claim 1 wherein the spindle is mounted on a rotatable turret, on which a plurality of spindles are mounted such that the plurality of spindle are rotatable into a transfer position and a roll removal position, wherein the airhorn is located at the transfer position, and wherein a roll remover is disposed at the roll removal position, and further wherein the roll remover contacts the spindle in two places at the roll removal position.

16. The apparatus of claim 15 wherein the roll remover is a push-off palm in contact with the spindle at substantially two locations.

17. The apparatus of claim 1 wherein the spindle is mounted on a rotatable turret, on which a plurality of spindles are mounted such that the plurality of spindle are rotatable into a transfer position and a roll removal position, wherein the airhorn is located at the transfer position, and wherein a roll remover is disposed at the roll removal position, and further wherein the roll remover contacts the spindle in substantially 360 degrees at the roll removal position.

18. The apparatus of claim 17 wherein the roll remover is a yoke mounted about the spindle.

19. The apparatus of 1 further comprising a mounting block disposed downstream of the airhorn, and above the conveyor, and a source of air mounted on the mounting block, disposed to create air flow between the conveyor and the block and from the source of air to the air horn to create an air curtain downstream of the spindle, such that air directs the leading edge of the film into the airhorn and over the spindle.

20. An apparatus for winding film from a pair of haul in rolls comprising:

a first rotatable spindle;

an airhorn, movable to be disposed over the spindle;

a film conveyor, to convey the film from the haul-in rolls to the airhorn; and a film guide means for guiding a leading edge of the film into its own nip at about the two to three o'clock position in the airhorn, wherein the film guide means are located within the airhorn on the upstream side of the airhorn.

21. The apparatus of claim 20 including an air guide means for guiding air away from upstream of the spindle, wherein the air guide means is located between the film guide and the film path leading to the spindle.

22. The apparatus of claim 20 further including air relief means for providing an escape route for air in the spindle, wherein the air relief means is located near a point of inflection of the film guide means.

23. The apparatus of claim 20 wherein the airhorn includes a static pinner means for pinning the leading edge of the film to the spindle.

24. The apparatus of claim 20 wherein the spindle has a winding surface, and the winding surface is tapered by no more 0.015 inches per foot.

25. The apparatus of claim 20 wherein the spindle has an air lubricant means for aiding in the removal of a wound roll of film, wherein the air lubricant means includes an inlet area greater than a hole area.

26. The apparatus of claim 25 wherein the inlet area is at least about four times greater than the hole area.

27. The apparatus of claim 20 wherein the first spindle and at least one other spindle are mounted on a turret means for moving the spindles into a transfer position and a roll removal position, wherein the airhorn is located at the transfer position, and wherein a roll remover means for contacting a spindle in two places and for pushing the roll off a spindle located at the roll removal position.

28. The apparatus of 20 further comprising a mounting block disposed downstream of the airhorn, and above the conveyor, and a source of air mounted on the mounting block, disposed to create air flow between the conveyor and the block and from the source of air to the air horn to create an air curtain downstream of the spindle, such that air directs the leading edge of the film into the airhorn and over the spindle.

29. A method of winding film comprising:

moving the film to a spindle;

rotating the spindle;

moving an airhorn over the spindle; and guiding a leading edge of the film into its own nip with film guide located within the airhorn on the upstream side of the airhorn.

30. The method of claim 29 including the step of guiding air away from upstream of the spindle.

31. The method of claim 29 including the step of statically pinning the leading edge of the film to the spindle.

32. The method of claim 29 including the steps of moving the spindle to a roll removal position and pushing a wound roll off the spindle by contacting the spindle with a roll remover.

33. The method of claim 29 further including creating an air curtain downstream of the airhorn to direct the leading edge of the film into the airhorn and over the spindle.

34. An apparatus for winding film from a pair of hail-in rolls comprising:

a rotatable spindle;

an airhorn, movable to be disposed over the spindle;

a conveyor to convey the film from the haul-in rolls to the airhorn; and an air guide located between the air horn and the film path leading to the spindle.

35. The apparatus of claim 34 including a film guide, located on the upstream side of the airhorn, to guide a leading edge of the film back into its own nip.

36. The apparatus of claim 34 further including a plurality of air relief holes in the film guide, and near a point of inflection of the film guide.

37. The apparatus of claim 34 wherein the spindle has an air inlet, and a plurality of outlet holes, and the inlet area is greater than the hole area.

38. The apparatus of claim 34 wherein the spindle is mounted on a rotatable turret, on which a plurality of spindles are mounted such that the plurality of spindle are rotatable into a transfer position and a roll removal position, wherein the airhorn is located at the transfer position, and wherein a roll remover is disposed at the roll removal position, and further wherein the roll remover contacts the spindle in substantially two places at the roll removal position.

39. The apparatus of 34 further comprising a mounting block disposed downstream of the airhorn, and above the conveyor, and a source of air mounted on the mounting block, disposed to create air flow between the conveyor and the block and from the source of air to the air horn to create an air curtain downstream of the spindle, such that air directs the leading edge of the film into the airhorn and over the spindle.

40. An apparatus for winding film from a pair of haul-in rolls comprising:

a conveyor to transport the film from the haul in rolls to the airhorn;

a rotatable spindle;

an airhorn, movable to be disposed over the spindle;

a mounting block disposed downstream of the airhorn, and above the conveyor; and a source of air mounted on the mounting block, disposed to create air flow between the conveyor and the block and from the source of air to the air horn to create an air curtain downstream of the spindle, such that air directs the leading edge of the film into the airhorn and over the spindle.

* * * * *